US006772747B1

(12) United States Patent
Vastag

(10) Patent No.: US 6,772,747 B1
(45) Date of Patent: Aug. 10, 2004

(54) HUNTING ARROW REST WITH LOADING GATE

(76) Inventor: Laszlo Vastag, R.R. 1, Box 135 A, Stamford, NY (US) 12167

( * ) Notice: Subject to any disclaimer, the term of this patent is extended or adjusted under 35 U.S.C. 154(b) by 0 days.

(21) Appl. No.: 10/234,537

(22) Filed: Sep. 4, 2002

(51) Int. Cl.[7] ..... F41B 5/22
(52) U.S. Cl. ..... 124/44.5; 124/24.1
(58) Field of Search ..... 124/24.1, 44.5

(56) References Cited

U.S. PATENT DOCUMENTS 4,351,311 A * 9/1982 Phares
4,917,072 A * 4/1990 Chang
5,031,601 A * 7/1991 Gunter ..... 124/44.5
5,042,450 A * 8/1991 Jacobson ..... 124/44.5
5,253,633 A * 10/1993 Sisko ..... 124/44.5
5,526,800 A * 6/1996 Christian ..... 124/44.5
5,529,049 A * 6/1996 Antalosky ..... 124/44.5
RE38,096 E * 4/2003 Branthwaite et al. ..... 124/44.5
6,557,541 B2 * 5/2003 Pinto ..... 124/44.5
6,561,175 B1 * 5/2003 Tidmore ..... 124/44.5

* cited by examiner

*Primary Examiner*—John A. Ricci
(74) *Attorney, Agent, or Firm*—Edward P. Dutkiewicz

(57) ABSTRACT

A hunting arrow rest frame, in a generally cylindrical configuration, has spaced threaded apertures in the frame at equally spaced angles from the vertical centerline of the frame. Each pin of a pair of pins is formed with threads for being adjustably received within a threaded aperture of the frame. The pins have exterior ends exterior of the frame and interior ends interior of the frame. The interior ends are closely spaced with respect to each other at a distance less than the diameter of an arrow shaft to support the arrow shaft during operation and use. The frame is coupled to a bow.

11 Claims, 5 Drawing Sheets

FIG 4
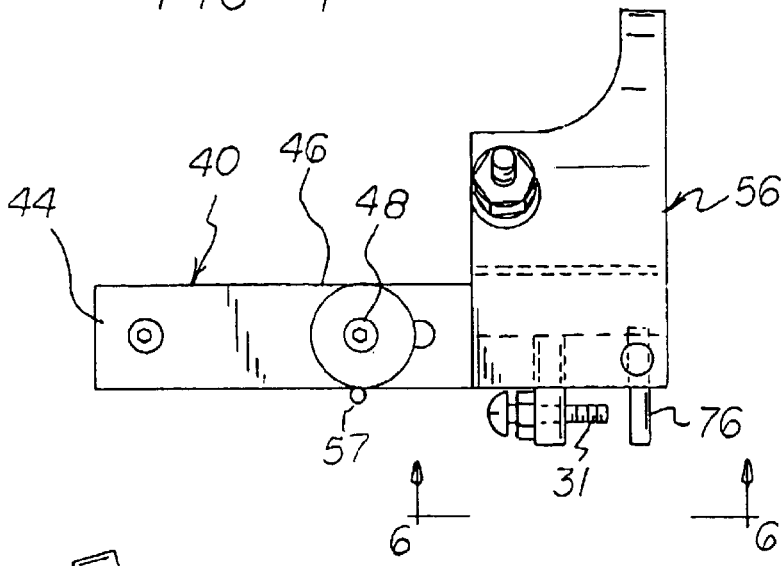
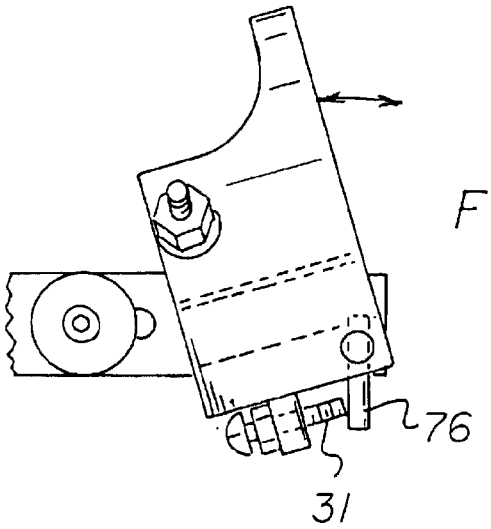
FIG 5
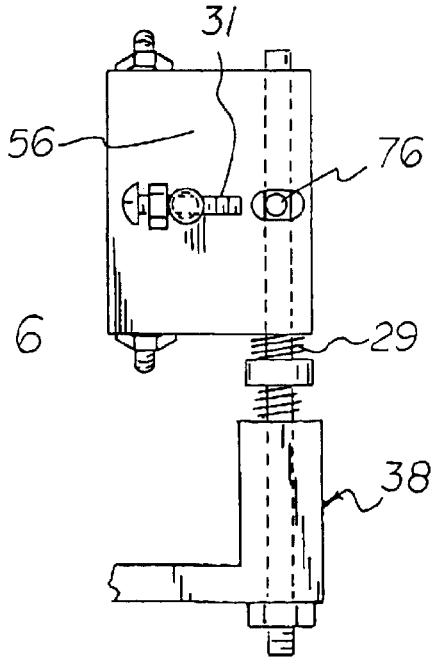
FIG 6

FIG 7
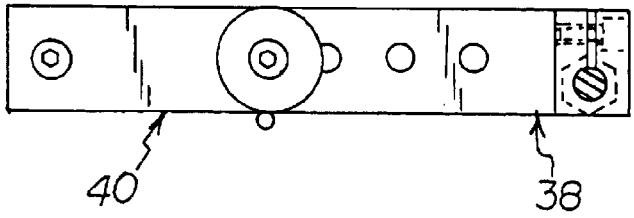
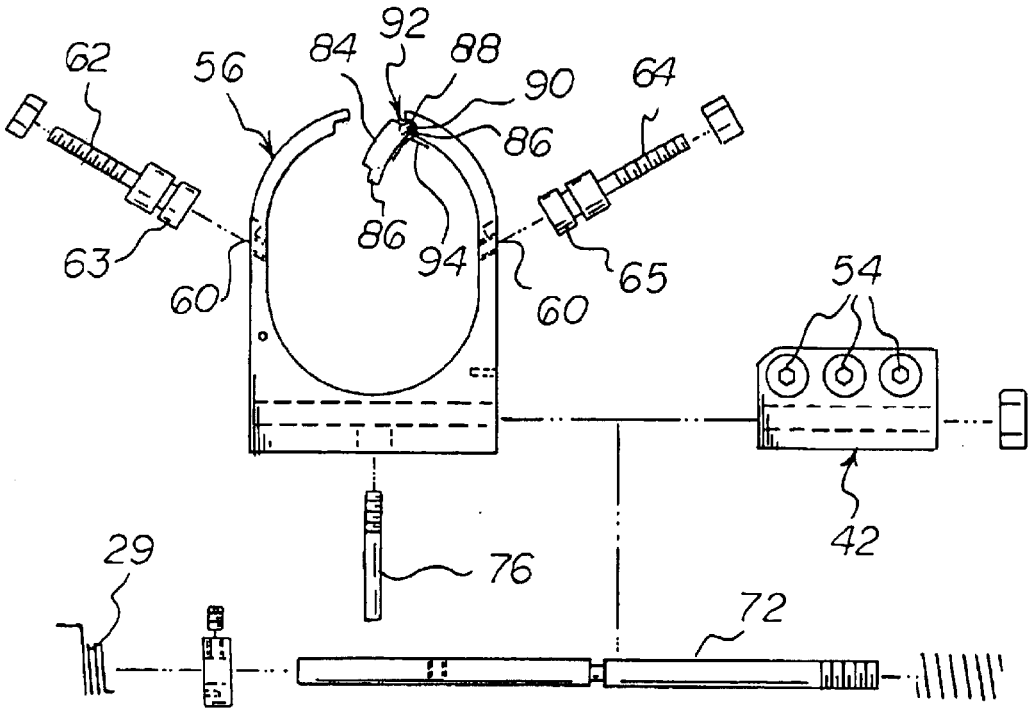
FIG 8

FIG 11
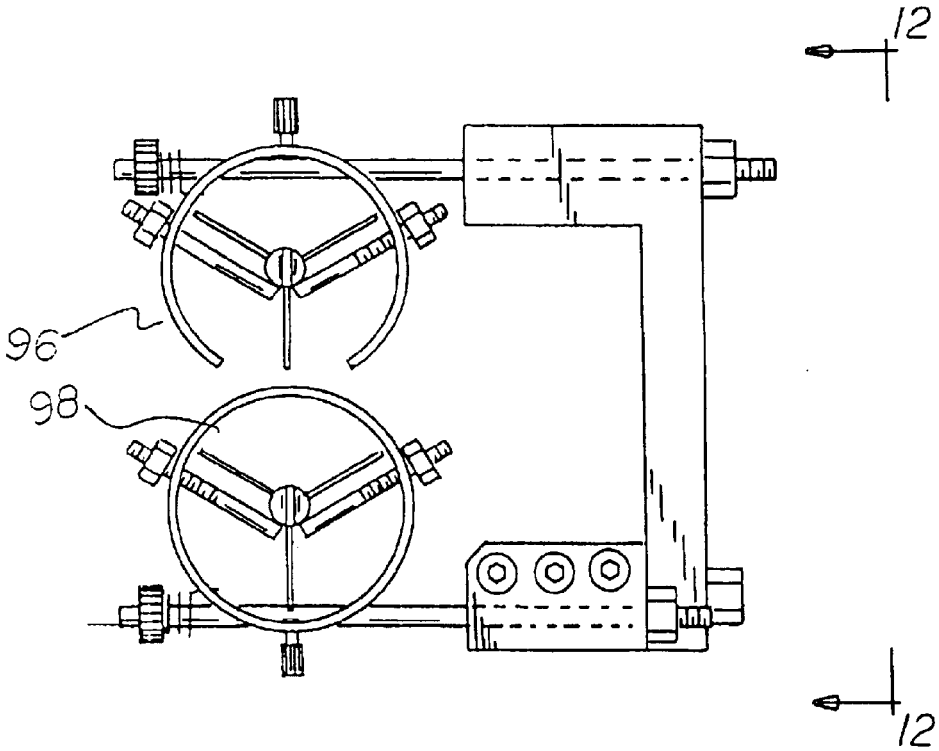
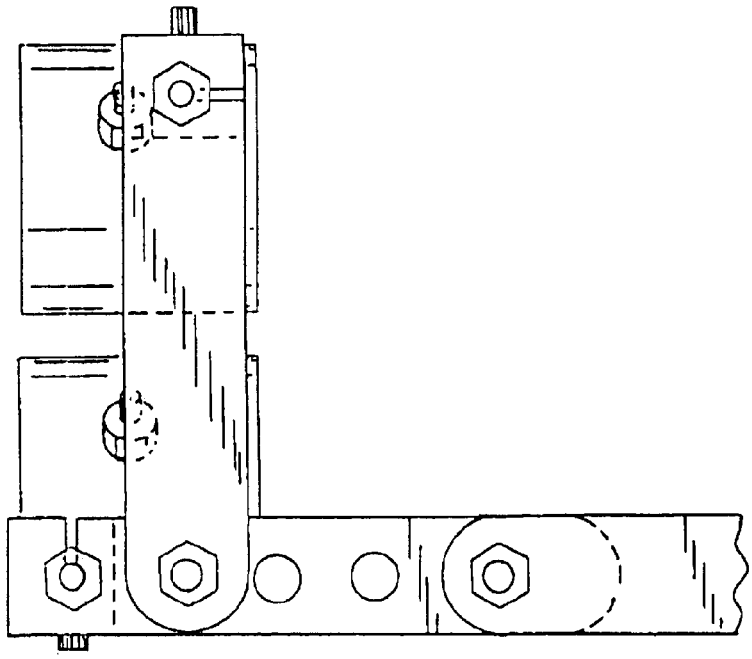
FIG 12

HUNTING ARROW REST WITH LOADING GATE

BACKGROUND OF THE INVENTION

1. Field of the Invention

The present invention relates to a hunting arrow rest with loading gate and more particularly pertains to properly orienting arrows on a bow through the funnel principle.

2. Description of the Prior Art

The use of arrow supports of known designs and configurations is known in the prior art. More specifically, arrow supports of known designs and configurations previously devised and utilized for the purpose of positioning arrows with respect to bows through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,042,450 to Jacobson discloses an arrow support for an archery bow. U.S. Pat. No. 5,896,849 to Branthwaite et al. discloses and arrow rest. U.S. Pat. No. 5,632,263 to Sartain discloses an automatic arrow positioning device. Lastly, U.S. Pat. No. 5,678,530 to Van Drielen discloses an arrow rest.

While these devices fulfill their respective, particular objectives and requirements, the aforementioned patents do not describe a hunting arrow rest with loading gate that allows properly orienting arrows on a bow through the funnel principle.

In this respect, the hunting arrow rest with loading gate according to the present invention substantially departs from the conventional concepts and designs of the prior art, and in doing so provides an apparatus primarily developed for the purpose of properly orienting arrows on a bow through the funnel principle.

Therefore, it can be appreciated that there exists a continuing need for a new and improved hunting arrow rest with loading gate which can be used for properly orienting arrows on a bow through the funnel principle. In this regard, the present invention substantially fulfills this need.

SUMMARY OF THE INVENTION

In view of the foregoing disadvantages inherent in the known types of arrow supports of known designs and configurations now present in the prior art, the present invention provides an improved hunting arrow rest with loading gate. As such, the general purpose of the present invention, which will be described subsequently in greater detail, is to provide a new and improved hunting arrow rest with loading gate and method which has all the advantages of the prior art and none of the disadvantages.

To attain this, the present invention essentially comprises a bow with a curved front portion with a centrally positioned handle. The curved portion has remote ends spaced from the handle. A string couples the ends. An arrow is next provided. The arrow has a linear shaft. The shaft has a remote end and a near end. The remote end is formed with a point. The near end has a radial slot 36 for positioning within the string prior to release and shooting. Next provided is a hunting arrow rest assembly. The arrow rest assembly is removably coupled to the handle of the bow. The hunting arrow rest assembly includes a two piece link. The two piece link has a fixed component. One end of the fixed component is removably coupled to the handle. The two piece link also includes a pivotable component. The pivotable component is in an L-shaped configuration. One end of the pivotable component is coupled to the fixed component with an intermediate threaded fastener. The pivotable component has a generally horizontally oriented cylindrical opening with a planar slot. A plurality of threaded fasteners are coupled through the planar slot. An arrow rest frame 56 in a generally cylindrical configuration is next provided. The arrow rest frame has a pair of circular apertures in horizontal alignment with the cylindrical opening of the pivotable component. The frame has a pair of spaced threaded apertures there through at equally spaced 60 degree angles from a vertical centerline of the frame.

Next provided is a pair of pins. Each pin is formed with threads for being adjustably received within one of the threaded apertures of the frame. The pins have exterior ends exterior of the cylinder. The pins also have interior ends interior of the cylinder. The interior ends are closely spaced with respect to each other at a distance less than the diameter of the shaft of the arrow for the support of the arrow shaft during operation and use. A threaded horizontal rod is next provided. The horizontal rod extends through the circular apertures of the frame and the cylindrical opening of the pivotal component for positioning the frame in a proper orientation with respect to the bow and the handle. Next provided is a threaded vertical rod. The vertical rod extends upwardly through the frame from the bottom most extent of the frame to contact and hold the horizontal rod in proper position during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hunting arrow rest with loading gate which has all of the advantages of the prior art arrow supports of known designs and configurations and none of the disadvantages.

It is another object of the present invention to provide a new and improved hunting arrow rest with loading gate which may be easily and efficiently manufactured and marketed.

It is further an object of the present invention to provide a new and improved hunting arrow rest with loading gate which is of durable and reliable constructions.

An even further object of the present invention is to provide a new and improved hunting arrow rest with loading gate which is susceptible of a low cost of manufacture with regard to both materials and labor, and which accordingly is then susceptible of low prices of sale to the consuming public, thereby making such hunting arrow rest with loading gate economically available to the buying public.

Even still another object of the present invention is to provide a hunting arrow rest with loading gate for properly orienting arrows on a bow through the funnel principle.

Lastly, it is an object of the present invention to provide a new and improved hunting arrow rest frame, in a generally cylindrical configuration, with spaced threaded apertures in the frame at equally spaced angles from the vertical centerline of the frame. Each pin of a pair of pins is formed with threads for being adjustably received within a threaded aperture of the frame. The pins have exterior ends exterior of the frame and interior ends interior of the frame. The interior ends are closely spaced with respect to each other at a distance less than the diameter of an arrow shaft to support the arrow shaft during operation and use. Coupling means join the frame to a bow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a side elevational view of the FIG. 3 embodiment taken along line 4—4 of FIG. 3.

FIG. 5 is a view similar to FIG. 4 but showing the frame in an angled orientation.

FIG. 6 is a bottom view taken along line 6—6 of FIG. 4.

FIG. 7 is a cross sectional view taken along line 7—7 of FIG. 3.

FIG. 8 is an exploded perspective view of the system shown in FIGS. 3 through 7.

FIG. 11 is a rear elevational view of the Hunting Arrow Rest With Loading Gate System showing a plurality of arrows being made ready to fire.

FIG. 12 is a side elevational view taken along line 12—12 of FIG. 11.

The same reference numerals refer to the same parts throughout the various Figures.

DESCRIPTION OF THE PREFERRED EMBODIMENT

Figure 1:
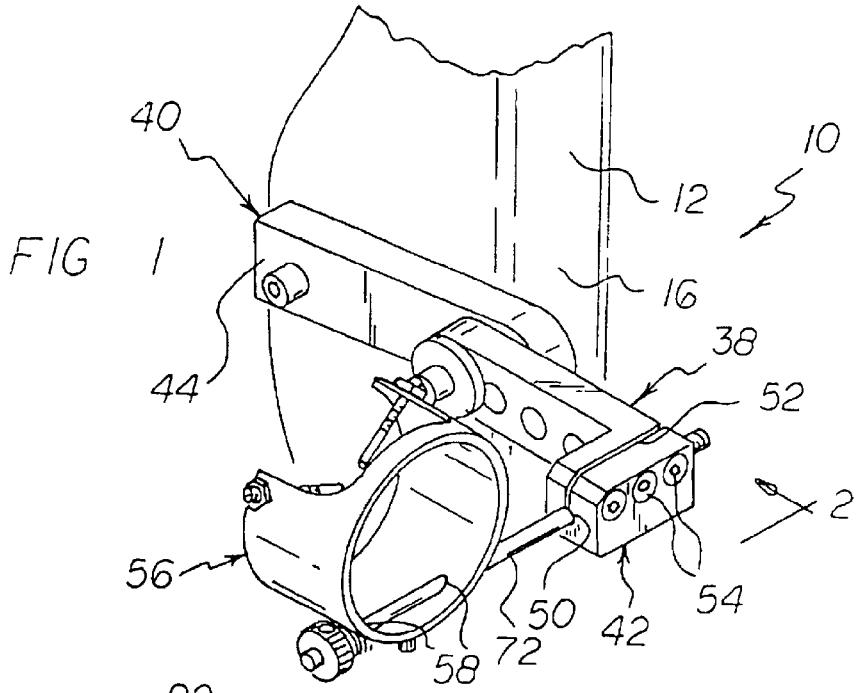
FIG. 1 is a perspective illustration of the hunting arrow rest with loading gate constructed in accordance with the principles of the present invention.

With reference now to the drawings, and in particular to FIG. 1 thereof, the preferred embodiment of the new and improved hunting arrow rest with loading gate embodying the principles and concepts of the present invention and generally designated by the reference numeral 10 will be described.

The present invention, the hunting arrow rest with loading gate 10 is comprised of a plurality of components. Such components in their broadest context include an arrow rest frame, a pair of pins and a coupling means. Such components are individually configured and correlated with respect to each other so as to attain the desired objective.

First provided is a bow 12. The bow has a curved front portion 14, 18 with a centrally positioned handle 16. The curved portion has remote ends 20, 22 spaced from the handle. A string 24 couples the ends.

An arrow 26 is next provided. The arrow has a linear shaft 28. The shaft has a remote end 30 and a near end 34. The remote end is formed with a point 32. The near end has a radial slot 36 for positioning within the string prior to release and shooting.

Next provided is a hunting arrow rest assembly 38. The arrow rest assembly is removably coupled to the handle of the bow. The hunting arrow rest assembly includes a two piece link 40, 42. The two piece link has a fixed component 40. One end 44 of the fixed component is removably coupled to the handle. The two piece link also includes a pivotable component 42. The pivotable component is in an L-shaped configuration. One end 46 of the pivotable component is coupled to the fixed component with an intermediate threaded fastener 48. The pivotable component has a generally horizontally oriented cylindrical opening 50 with a planar slot 52. A plurality of threaded fasteners 54 are coupled through the planar slot.

An arrow rest frame 56 in a generally cylindrical configuration is next provided. The arrow rest frame has a pair of circular apertures 58 in horizontal alignment with the cylindrical opening of the pivotable component. The frame has a pair of spaced threaded apertures 60 there through at equally spaced 60 degree angles from a vertical centerline of the frame.

Next provided is a pair of pins 62, 64. Each pin is formed with threads for being adjustably received within one of the threaded apertures of the frame. The pins have exterior ends 66 exterior of the cylinder. The pins also have interior ends 68 interior of the cylinder. The interior ends are closely spaced with respect to each other at a distance less than the diameter of the shaft of the arrow for the support of the arrow shaft during operation and use. In the FIG. 8 embodiment, rollers 63, 65 at the at the ends of pins 62, 64 allow for smoother movement of the arrow.

A threaded horizontal rod 72 is next provided. The horizontal rod extends through the circular apertures of the frame and the cylindrical opening of the pivotal component for positioning the frame in a proper orientation with respect to the bow and the handle.

Next provided is a threaded vertical rod 76. The vertical rod extends upwardly through the frame from the bottom most extent of the frame to contact and hold the horizontal rod in proper position during operation and use.

The present invention is a hunting arrow rest with loading gate 10 which is composed of an arrow rest body or frame, pivoting shaft, and a two piece link which functions like a funnel. Due to the angular shape of the funnel walls, the objects dropped in it are always drawn to the center. On my arrow rest the arrow is driven to the center of a circular or oval shape frame by two pins which are in an angular position in between a horizontal line and 30 degrees. This is the launching location of the arrows. In other words, the arrow sits on two inverted pins having the tops connected by an arc. It does not matter in what position the arrow rest is. It can be tilted to the left, right or turned upside down. When it is held in a horizontal shooting position the arrow will always be in between the lower tips of the two pins, the arrow launching location, and the connecting arc on the other end of the pins will prevent the arrow from fall out from the arrow rest when it is turned upside down. This gives a hunter the advantage of being able to carry the bow held in one hand like a rifle. When game appears the hunter only has to raise the bow to a vertical shooting position, aim and release the bow string. With this invention, the arrow will for sure be on the launching position in between the pins. A bow can be equipped with two arrow rests, mounted one of top of the other, to launch two arrows at the same time, giving another hunting advantage.

Figure 2:
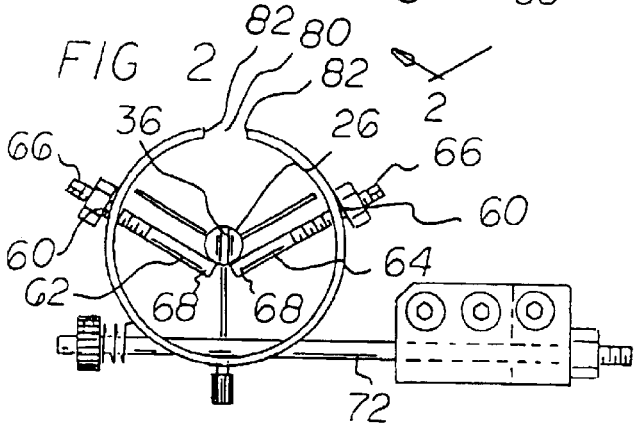
FIG. 2 is an end view taken along line 2—2 of FIG. 1.
Figure 3:
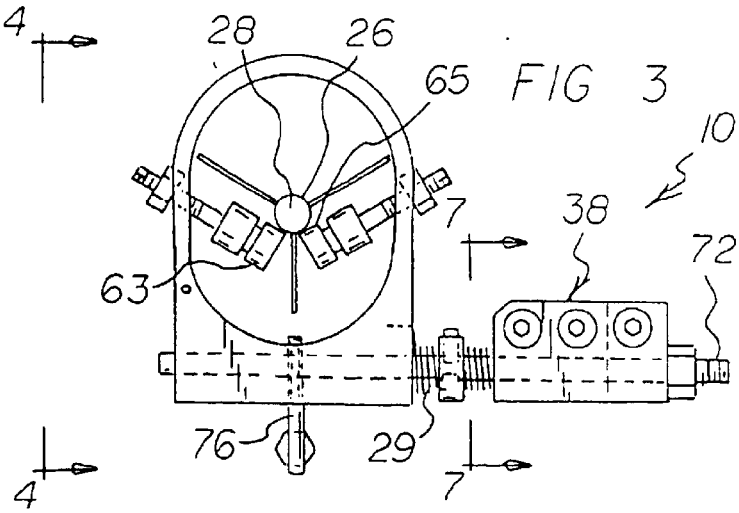
FIG. 3 is an end view similar to FIG. 2 but showing an alternate embodiment of the invention.

A circular shape frame arrow rest is shown in FIGS. 1 and 2. It includes the pivoting shaft and the two piece link. An oval shaped frame arrow rest is shown in the figure which is a back view with an arrow in place in the center. This version is more easily manufactured, since it can be molded in a die, and the oval shape gives more wen or feather clearance when the arrow departs from the arrow rest. The arrow rest body can be formed of steel or plastic. It is made of a rectangular piece of plastic approximately 1-⅜"×1-⅞"×2-¾". The top of the rectangular plastic is rounded forming an arc and the bottom region is straight, and the center has an oval shape cutout forming an oval shape frame. At the bottom of the oval shape frame, at the corner, the plastic is drilled through from one extreme to the other extreme, with a ¼ inch drill, forming a bored hole which is the location for the pivoting shaft. Parallel with the ¼ hole it is drilled a smaller and shorter hole about ⅙ inch. In this hole will be hooked the hook from the longer arm of a regaining spring 29, FIG. 8. The short arm of the same spring will be hooked in a 1/32 hole which is drilled on a flat round steel having the thickness of about ¼ inch, a diameter about ½ inch. The round steel all around is knurled for good gripping. Parallel with the 1/32 hole, in the center of the round steel is drilled through a ¼ inch hole. This hole will fit the pivoting shaft. The flat round steel will slide on the pivoting shaft until it meets a groove all around the shaft about 1/16 inch deep, 3/16 inch wide and located about in the middle of the pivoting shaft. The flat round steel and the regaining spring can be mounted also on the extreme top of the pivoting shaft as shown in FIG. 1 and 2. In the groove all around the shaft will fit a 10-32 set screw which has a slit at one end for a screwdriver and at the other end the thread removed on a portion of 1/16 inch. This set screw goes in a threaded hole on the round flat steel intersecting the ¼ inch hold. One end of the pivoting shaft has a ¼ 20 thread about one inch long, which will take a ¼ 20 nut. On the pivoting shaft, opposite side of the ¼ 20 thread, about one inch from the extreme, the pivoting shaft is drilled across for an 8-32 thread. In this threaded hole will be screwed in a stud about ⅝ inch long having a diameter about 5/32 inch. Part of this stud, about ¼ inch long is threaded for an 8-32 thread. A hole for a 10-32 screw is drilled from both extremes of the arrow rest body. The hole is drilled at an angle of 30 degrees. A round cavity is machined on the top of this hole, at the same angle, which is a clearance for a 10-32 locking nut. This locking nut locks in place the arrow guide pins. The guide pins are made of a 10-32 threaded rod about 1-¼ inch long having a slot in the top for a screwdriver and a portion of ⅛ inch, the thread is removed. Also on the other end the thread from the guide pin is removed on a length of ½ inch forming the tip of the arrow guide pin, the arrow support, on which the arrow actually rests. Also on the tip of the arrow guide pins can be mounted small roller bearings. Behind each roller bearing is mounted a plastic bushing. The bushing height is the same height as the roller bearings. The purpose of this is to prevent the arrow from falling behind the roller bearings. The arrow will roll on the edges of the bearings. The oval shape frame arrow rest must have, above the arrow guide pins location in the upper corner, a large radius cut out leaving only a small closed portion on the top forming the arc.

The cutout is needed in order to give the maximum clearance for the arrow vanes when the arrow departs from the bow by being pushed by the bow cord or string. The pivoting shaft hole, in the middle area is intersected by an oval hole. Through this oval hole will be screwed in the pivoting shaft, in the threaded hole will be screwed in the stud. This is going to happen after the pivoting shaft was pushed through the pivoting shaft hole. The stud has two roles. The first role is to prevent the pivoting shaft from coming out of the pivoting hole. The second role is to act as a stop when the adjusting screw and the locking nut is adjusted against the stud. The adjusting screw is screwed through another stud, which is the same as the prior stud except that it is bigger in diameter, has a slot on the top for a screwdriver, has a threaded hole to take the adjusting screw and it is screwed in the bottom of the oval shaped arrow rest. It is screwed in a threaded hole having the same thread as the stud and is located in the center area on the bottom of the frame in the same line with the oval hole. The purpose of the oval hole is to allow the frame to pivot on the pivoting shaft when it is pushed down by a departing arrow from the bow, pushed by the bow cord or string. In the Figures, the arrow rest is shown from a side view with the stopping stud screwed in the pivoting shaft in its location, the oval hole. In front of all this it can be seen, screwed in the bottom of the arrow rest frame the stud with the adjusting screw and locking nut in place. In another Figure, the arrow rest is shown activated by the arrow and it pushed the arrow rest frame down. Also you can see the stud without any change but the stopping screw is touching it. The above action is called the cushion and it is adjusted with the adjusting screw and the regaining spring. It is activated by the flat round steel by turning it and it is locked in place by the locking set screw on the flat round steel when the desired cushioning for the arrow is achieved. One end of the regaining spring is hooked directly in a hollow on the side of the arrow rest body and the other end of the spring is hooked in the small hole in the flat round steel which has its location over and around a groove on the pivoting shaft. The flat round steel is turned clockwise keeping the body of the arrow rest in a vertical position and until a desired tension of the spring is obtained then it is locked in place with the locking set screw which fits in the groove on the pivoting shaft. The adjusting screw is adjusted to the desired depth movement of the arrow rest when it is activated by a departing arrow from the bow. The above adjustments are needed to minimize porpoising arrow flight and fishtailing arrow flight. Theoretically, fishtailing and porpoising arrow flight can be eliminated completely by the threading through a hole a string. The hole is located on the left side of the arrow rest above the pivoting shaft and is about 3/32 of an inch in diameter. It functions as follows. The string is connected at one end to the 3/32 inch hole which is above the pivoting shaft of the arrow rest body. The other end of the string is connected to the cord or string of the bow. The string has a particular length same as the draw length of the bow. About in the middle area of the string it is tightened one end of a spring or elastic string. The other end is tightened to the bottom of the bow limb.

Figure 9:
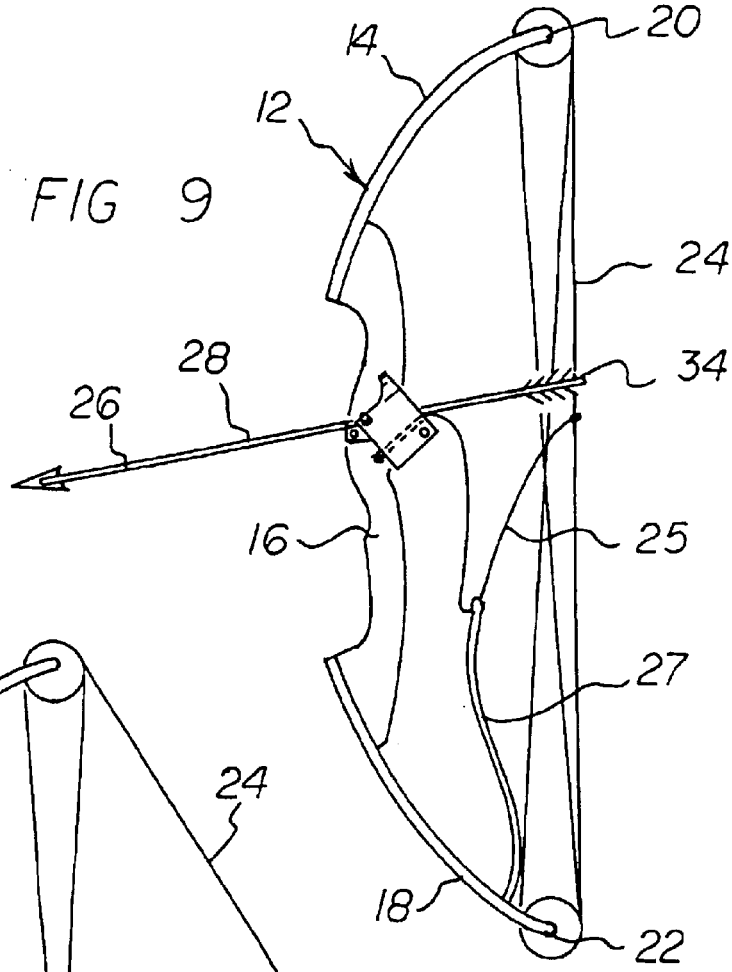
FIGS. 9 and 10 are illustrations of a compound bow employing the hunting arrow rest with loading gate of the present invention illustrating the arrow in alternate orientation.

FIG. 9 shows a compound bow in a relaxed position with the arrow in place. The arrow rest is in a tilted forward position with the arrow in position. The tilted position of the arrow rest is relocated by the mechanisms of FIGS. 4, 5 and 6, also tilted in a down position of FIGS. 5 and 9. The string is in a V-shape being rolled out of the way by the elastic string.

Figure 10:
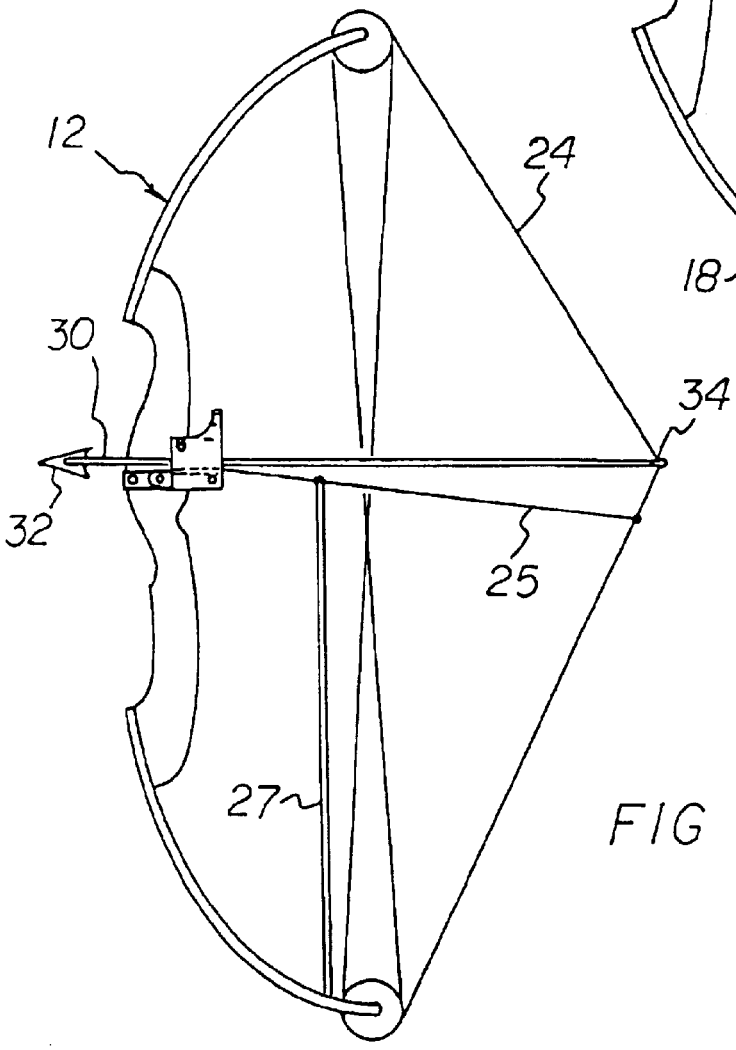

In FIG. 10, the bow is in a drawn position. The string 25 and the elastic string 27 are stretched, the arrow rest is in a vertical position which pivots on the pivoting shaft. The arrow also is in a straight horizontal position. At the moment when the bow is released the string collapses by being pulled out of the way by the elastic string. At the release of the bow string, the arrow rest will fall in a forward tilted position by its own weight. A threaded bolt 31 will allow adjustment of the travel of the arrow rest. The regaining spring 29 can be reversed from a left hand tension to a right hand tension. In this case the spring will help the arrow rest to act more quickly to push the arrow rest in a forward tilted position, besides relying only on the weight of the arrow rest. Otherwise, the regaining spring has to bring the arrow rest in the vertical position. When the string and elastic string are used the regaining spring has to be eliminated or the right hand regaining spring has to be used. The string can be eliminated and replaced with a spring or an additional elastic string but when the bow is released it might interfere with the flight of the arrow. The other version it is a more positive version.

An opening 80 can be provided in the middle of the arc the size of the diameter of an arrow. See FIG. 2. This forms two hooks 82. This will allow the arrow to be dropped in the arrow rest frame, rather than to push through it, making the loading of the bow easier and quicker. The opening can be closed with a gate 84, FIG. 8, which has steps 86 on the lower part on both ends 88, FIG. 6. One of the steps has a hole 88 for a pin 90 which goes through a hole drilled in the frame forming a hinge 92. Over the pin will go a wire spring 94, FIG. 8, which will have a location clearance machined in the hook. The spring will push the gate always up in a close position after the arrow was dropped in the frame maintaining the shape of the arc. The other step on the gate is to stop the gate going in the other direction. The above is the arrow loading gate and it is supposed to open one direction only which is down when it is pushed down by a loadable arrow.

The hunting arrow rest with the loading gate can be set up by the hunter in two ways. One way of using is the cushioning mechanism adjustment with the adjusting components on the arrow rest and the other way is by using the forward tilted position method of the arrow rest which is a space leaving method for a free, clean, clear arrow departure meaning that as soon as the bow string is released by the hunter, the departing arrow will be in the air right away without the need to activate any additional mechanism since the arrow rest leans forward by its own weight clearing the space for the arrow flying for a free clean clear departure without any obstruction. Therefore, theoretically any porpoising or fishtailing arrow flight will be eliminated. In any event, the hunting arrow rest with the loading gate is built with the same components, no extra components are required, regardless of either method from the above the hunter desires to use. The only difference of the using method is, eliminating or reversing the regaining spring on the pivoting shaft and installing an extra string and elastic string on the bow. When the forward tilting position of the arrow rest method is used, no wen or feather clearance is needed in between the arrow guide pin so it can be connected forming a V-shape, but it will work the same with the space between the guiding pins.

The arrow rest is fastened on the bow by a link which is made of two pieces. The first piece is a rectangular piece is approximately ⅜×¾×2 inch and has at the extremes a 5⁄16 of an inch hole. The second hole is not shown in the figures. The second piece of the link is an L-shaped steel piece having in line threads 5⁄16 inch threaded holes for length adjustment about 7⁄16 inch apart from each other. The L-shaped piece is connected to the first part of the link with a 5⁄16 18 cup head screw, not shown. The short leg of the link has a ¼ hole drilled through from one extent to the other. The pivoting shaft will fit in this hole. Above this hole is a slit which cuts through all the way along from one extreme to the other. As can be seen in the figures, the short leg has three holes, ⅜ inch apart from each other. The holes are for 10-32 screws which go through the front part of the slit and accordingly screwed in the back part of the slit which has three 10-32 threaded holes for locking. In between the retaining spring, flat round steel, and the link tensioned is a tension spring. The role for this spring is to keep the pivoting shaft in its location in the link. By turning the locking nut, compress the spring, and move the arrow rest to the right. To move the arrow rest in an opposite direction unscrew the locking nut and the spring will push the arrow rest in the opposite direction. When a desired location is obtained then the arrow rest can be locked in position with the three 10-32 screws. In this manner, the direction of the arrow can be adjusted to fly more to the left or to the right.

As seen in the Figures, a washer is provided for the 5⁄16 18 cup head screw which connects the two pieces of the link together. It is a regular stand and washer, same diameter as the width of the link except that on the side has welded a pin 57 about 3⁄32 inch in diameter and ⅜ inch long. The reason for this pin is to prevent the set up of the arrow rest to move when the 5⁄16 18 screw is tightened. It can happed that the whole thing might turn when the screw is tightened but the pin will prevent this since it will hook in the side of the link.

All the arrow rests for a body of the prior art support the arrow on the bottom part of the arrow shaft meaning that in most of the cases the arrow is supported by two curved pins wherein the arrow can easily fall off making the arrow impossible to be launched unless it is put back in position on the supporting pins. This can be very frustrating in a hunting situation wherein a shot at game is missed causing a hunter to wait for possibly hours for the game to return.

The invention uses a simple basis idea. It is a funnel principal. As small round objects or liquid enters a funnel, the angular shaped wall of the funnel drives the objects always to the center of the funnel. The funnel principal is applied to an arrow rest as follows. A ½ inch wide slide is cut from a 2" diameter pipe obtaining a circle and dividing the cut of slide in three parts, 120 degrees from each other. The divisions beginning from the center of the circle. One of the divisions is on the bottom of the circle pointing up to the center of the circle, parallel with the vertical centerline of the circle. The other two division points are on the left and right side of the circle. These divisions are needed since the arrow has three feathers glued to the arrow shaft 120 degrees apart from each other and the arrow will be placed in the center of the circle. From the two division points of the circle which starts from the left and right side of the circle are mounted two pins going downward in 120 degree thirds the center of the circle, leaving just before the intersection point of the pins, in the center of the circle, leaving a gap smaller than the diameter of the arrow shaft. In this manner, the arrow is supported by the pins which are holding the arrow inverted forming an angle which will drive the arrow to the bottom of the pins in the center of the circle which is the launching post of the arrow. This is exactly like a funnel from which the front and back portion was slided off and only an arrow central portion was saved. If the front of the arrow is thrown there, holding the back of the arrow in hand, or by the string of the bow, the arrow would be driven to the center of the funnel like any object or liquid when the funnel was intact. As mentioned above, above the pins are placed in a circle so that the upper part of the circle connects the top of two pins in a form of an arch. Also, as mentioned previously, the lower part of two pins, just before intersecting, have a gap which is a clearance for one of the arrow feathers, two of the feathers are parallel with the two pins.

The two pins in 120 degrees angle from each other will make the arrow stay on the arrow launching post when the bow is held in a regular vertical shooting position. The 120 degrees is not critical, any angle in between horizontal line and 30 degrees is acceptable. The top of the circle or the arch which connects the two pins on the top has the role to prevent the arrow to fall off the arrow rest when the bow is turned completely upside down or any other position. When the bow is held in a vertical shooting position the pins will drive the arrow to the lower part of the pins which is the arrow launching post.

The above gives to a bow hunter few good advantages. The first is in a walking hunting situation. The bow can be carried in the woods, holding the bow in one hand like a rifle and when the game appears, the bow is brought up in a vertical shooting position, drawn, aimed and the arrow is released. The arrow was already placed on the arrow rest and one end on the bow string. A bow with a standard arrow rest normally is carried in two hands. The second is in a tree posting hunting situation. In this position it becomes frustrating to hold the bow in the hands for hours in the cold and keep your eyes on the hunting terrain for game and at the same time keep watching your arrow to assure that it is still on the arrow rest pins. Using the arrow rest of the present invention, the bow can be hung up or laid down next to the hunter and when the game appears, it can be picked up quickly, drawn, aimed and the arrow released. No matter how fast an arrow flies, a deer always notices or hears it when a flying object, like an arrow, approaches the deer. By instinct the deer ducks or jumps from the front of the arrow. A hunter has to wait for the deer to turn away from him in order to have a greater chance to hunt down the deer. With the present arrow rest system, two arrow rests can be mounted on top of each other on the bow, giving the advantage of launching two arrows at the same time making it more difficult, or impossible, for a deer to protect himself from two arrows coming toward him.

The pivoting shaft also can be mounted above the circular frame, above the launching pins. Note FIGS. 11 and 12. The bottom of the circle 96 can be cut open below the launching pins which will make them the same angular position of the funnel principle and the arrow rest will work just fine. With the above setup the regular closed bottom arrow rest 98, the two arrows can be brought closer to each other. One arrow rest has the pivoting shaft on the top of the circle arc with an open bottom and the other arrow rest has the pivoting shaft at the bottom of the circular frame with the closed bottom. It makes no difference if two fully closed circular frame arrow rests are mounted on top of each other, or if only one fully closed circular frame arrow rest and one open bottom circle frame arrow rest are mounted on the top of each other. This is strictly to make the setup of the bow more practical, convenient, and easier in case the user desires to launch two arrows at the same time with a single bow. Either way the arrow rest works just as fine. Any of the arrow rests are mounted on the bow with a two piece mounting link as in the prior embodiments. These arrangements will protect the pivoting shaft on the bottom and on the top.

The arrow rest and frame move forward in a tilted position when an arrow is launched through it. The arrow rest and frame are elevated in a vertical shooting position by a stretched string which connects the arrow rest and the bow string 24. The elevating string is pulled out of the way before the arrow is launched, by an elastic supplemental string 25 connected to the middle of the elevating string and the bottom of the bow limb. See FIGS. 9 and 10.

A washer has a pin welded on the side which hooks in the side of the two piece link. This prevents rotation of the washer securing the adjustment of the arrow rest. One piece of the link has a hole with a slit above and two or more holes in line to secure movement on the shaft which goes through it. Note FIG. 8.

The upper part of the guide pins are connected by an arc. If so desired, the arc can be installed with a loading gate 84. Without the gate, it will still work.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawing and described in the specification are intended to be encompassed by the present invention.

therefore, the foregoing is considered as illustrative only of the principles of the invention. Further, since numerous modifications and changes will readily occur to those skilled in the art, its is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hunting arrow rest system used in conjunction with a bow and arrow, the system having an arrow rest with a loading gate, the system allowing for the proper orienting of arrows on a bow through the funnel principle, the system comprising, in combination:

a bow having a curved front portion with a centrally positioned handle, the curved portion having remote ends spaced from the handle with a string coupling the ends;

an arrow having a linear shaft with a remote end having a point and a near end having a radial slot for positioning within the string prior to release and shooting;

a hunting arrow rest assembly removably coupled to the handle of the bow, the hunting arrow rest assembly including a two piece link having a fixed component with one end removably coupled to the handle to effect the coupling between the fixed component and the handle, the two piece link also including a pivotable component in an L-shaped configuration having one end coupled to the fixed component with an intermediate threaded fastener, the pivotable component having a generally horizontally oriented cylindrical opening with a planar slot and a plurality of threaded fasteners coupled through the planar slot;

an arrow rest frame in a generally cylindrical configuration having a pair of circular apertures in horizontal alignment with the cylindrical opening of the pivotable component, the frame having a pair of spaced threaded apertures there through at equally spaced 60 degree angles from a vertical centerline of the frame;

a pair of pins, each pin being formed with threads for being adjustably received within one of the threaded apertures of the frame, the pins having exterior ends exterior of the cylinder and interior ends interior of the cylinder, the interior end being closely spaced with respect to each other at a distance less than the diameter of the shaft of the arrow for the support of the arrow shaft during operation and use;

a threaded horizontal rod extending through the circular apertures of the frame and the cylindrical opening of the pivotal component for positioning the frame in a proper orientation with respect to the bow and the handle; and a threaded vertical rod extending upwardly through the frame from the bottom most extent of the frame to contact and hold the horizontal rod in proper position during operation and use.

2. A hunting arrow rest system comprising:

an arrow rest frame in a generally cylindrical configuration, the frame having spaced threaded apertures there through at equally spaced angles from the vertical centerline of the frame, the frame also having a pivotable component in an L-shaped configuration coupled thereto;

a pair of side-of-pin, arrow-supporting, downwardly displaced pins, one pin through each threaded aperture, each pin being formed with threads for being adjustably received within the threaded apertures of the frame, the pins having exterior ends exterior of the frame and interior ends interior of the frame, the interior ends being closely spaced with respect to each other at a distance less than the diameter of a shaft of an arrow for the support thereof during operation and use; and coupling means to join the frame to a bow.

3. The system as set forth in claim 2 wherein the arrow rest is in a closed configuration.

4. The system as set forth in claim 2 wherein the arrow rest includes an opening.

5. The system as set forth in claim 2 wherein the frame includes an opening and a gate pivotably coupled to the frame to selectively open and close the opening.

6. The system as set forth in claim 2 wherein the coupling means includes a pivot for pivotably mounting the frame to the bow.

7. The system as set forth in claim 6 and further including a supplemental string coupling the frame to the bow string whereby the pulling of the bow string will orient the frame to the intended direction of arrow flight and the release of the bow string will allow the frame to pivot to an angular orientation with respect to the bow string and bow.

8. The system as set forth in claim 2 wherein the arrow rest frame may function as a standard arrow rest with a cushioning mechanism and, in the alternative, as a space clearing arrow rest for a free, clean, clear arrow departure.

9. The system as set forth in claim 2 and further including a second arrow rest frame, one arrow rest frame having a pivoting shaft at the top and an opening at the bottom and the other arrow rest frame having a pivoting shaft at the bottom whereby the arrow rest frames may be used individually for launching one arrow and, in the alternative, the arrow rest frames may be used concurrently for launching two arrows at one time.

10. The system as set forth in claim 2 and further including a two piece mounting link with a rotation prevention washer and a pin sticking down to prevent excess rotation.

11. The system as set forth in claim 2, the system further including each pin having at least one associated roller coupled to the pin to contact with and support an arrow.

* * * * *